United States Patent [19]

Girard

[11] 3,930,293

[45] *Jan. 6, 1976

[54] METHOD OF REPLACING THE TRANSFER CORES OF YARN PACKAGES WITH RESILIENT REPLACEMENT CORES

[76] Inventor: Herbert A. Girard, 1025 Woodland Drive, Gastonia, N.C. 28052

[ * ] Notice: The portion of the term of this patent subsequent to Aug. 1, 1989, has been disclaimed.

[22] Filed: June 27, 1974

[21] Appl. No.: 483,814

Related U.S. Application Data

[60] Division of Ser. No. 276,318, July 31, 1972, Pat. No. 3,833,974, which is a continuation-in-part of Ser. No. 105,920, Jan. 12, 1971, Pat. No. 3,681,007.

[52] U.S. Cl. ..... 28/72 R; 8/155; 28/58 B

[51] Int. Cl.[2] ..... D01H 9/00

[58] Field of Search..... 28/1 R, 21, 75 R, 75 WT, 28/58 B, 72 R; 29/200 D; 68/189, 198; 242/1 R; 8/155

[56] References Cited

UNITED STATES PATENTS

| | | | |
|---|---|---|---|
| 1,652,992 | 12/1927 | Krantz | 28/72 R UX |
| 2,736,184 | 2/1956 | Harvey, Jr. et al. | 68/189 X |
| 3,374,959 | 3/1968 | Tigges | 28/1 R UX |
| 3,425,110 | 2/1969 | Willis | 28/75 WT |
| 3,618,184 | 11/1971 | Pearce et al. | 28/21 X |
| 3,681,007 | 8/1972 | Girard | 28/21 UX |

FOREIGN PATENTS OR APPLICATIONS

| | | | |
|---|---|---|---|
| 1,259,559 | 3/1961 | France | 28/1 R |
| 1,057,575 | 2/1967 | United Kingdom | 242/1 R |

*Primary Examiner*—Robert R. Mackey
*Attorney, Agent, or Firm*—Kane, Dalsimer, Kane, Sullivan and Kurucz

[57] ABSTRACT

A method for transferring a package of yarn supported by a transfer core to a replacement core including the steps of inserting the replacement core into the transfer core, removing the transfer core relative to the package of yarn and the replacement core, holding the package of yarn during withdrawal of the transfer core, and permitting the yarn and replacement core to interengage in completing the transfer of the yarn onto the replacement core. There is also provision for the steps of compressing the resilient core to reduce its size, compressing the package of yarn, and anchoring the replacement core against axial displacement.

10 Claims, 7 Drawing Figures

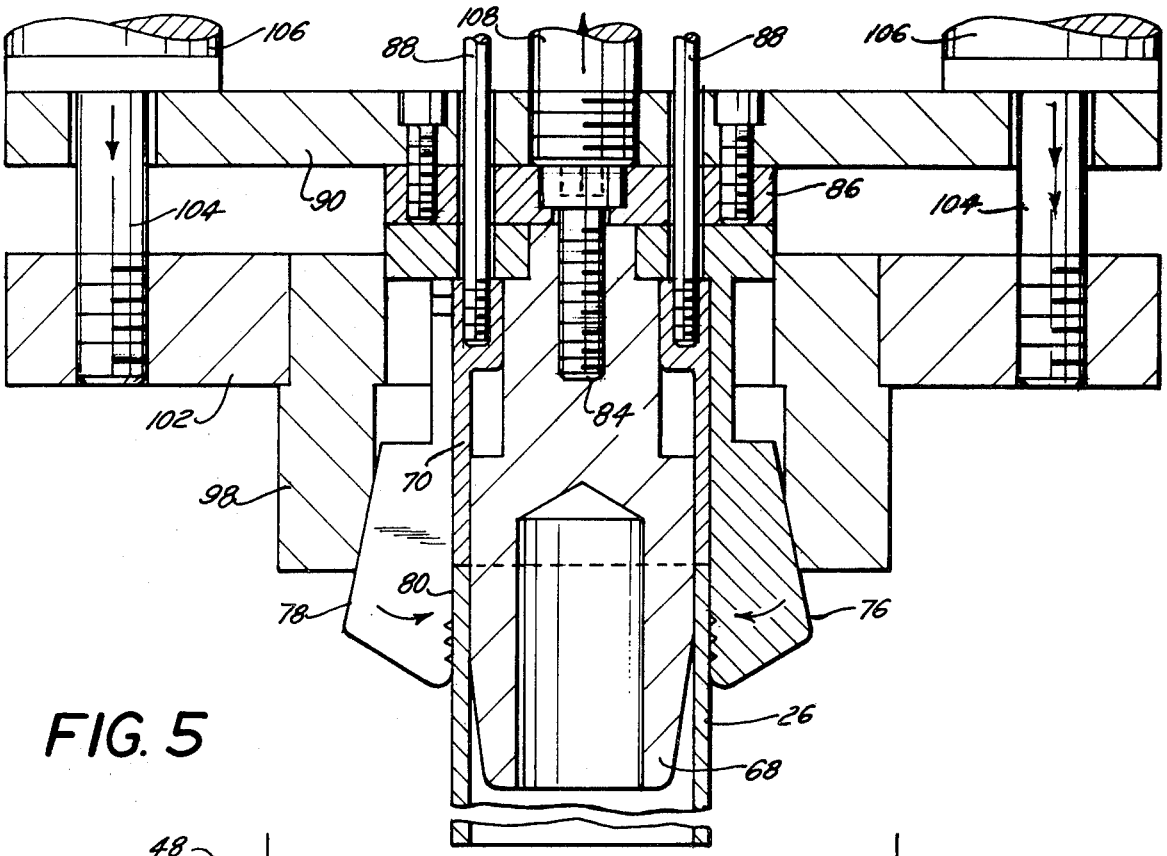
FIG. 5
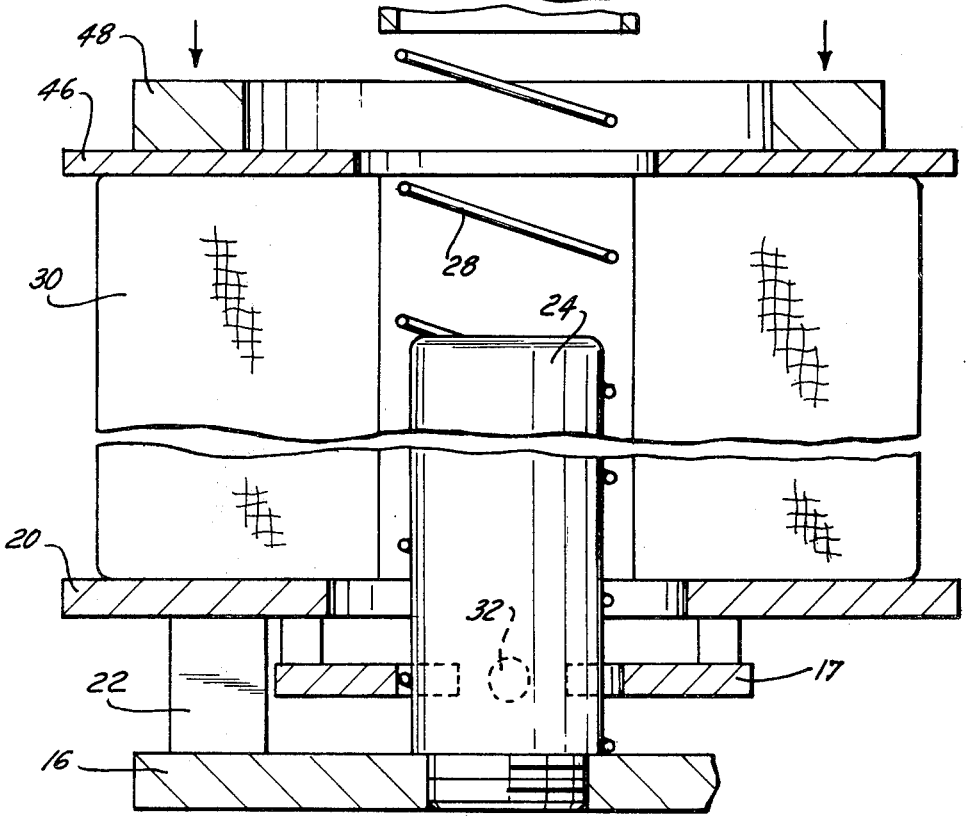

METHOD OF REPLACING THE TRANSFER CORES OF YARN PACKAGES WITH RESILIENT REPLACEMENT CORES

CROSS REFERENCE TO RELATED APPLICATIONS

This application is a division of application Ser. No. 276,318, filed July 31, 1972 (now U.S. Pat. No. 3,833,974 granted Sept. 10, 1974). Application Ser. No. 276,318 is a continuation-in-part of application Ser. No. 105,920, filed Jan. 12, 1971 (now U.S. Pat. No. 3,681,007 granted Aug. 1, 1972).

BACKGROUND OF THE INVENTION

The invention relates to an apparatus for processing yarn packages for dyeing and, in particular, to an apparatus for replacing a relatively impervious transfer core of a yarn package with a dye penetrating foraminous core.

Yarn that has been processed for dyeing may be in the form of bulked continuous filament thermoplastic yarn such as polyester, nylon or cellulose triacetate yarn, as well as spun yarn, such as direct spun rayon having residual shrinkage of up to 20 percent when exposed to conditions of high humidity or when immersed in aqueous solutions, or acrylic yarn having high residual shrinkage by reason of unrelaxed heat sensitive fibers in the yarn. This yarn is generally wound into package form about a cardboard or paper transfer core or tube such that the outer portion of the package is at substantially a desired bulk level whereas the innner portion is somewhat below this level. As disclosed in U.S. Pat. No. 3,425,110, the bulk level of the inner portion of the package may be increased by simultaneously removing the cardboard package core while inserting a perforate dye core or tube of a predetermined smaller diameter than the cardboard core. The inner portion of the highly stretchable yarn then contracts (and gains bulk) about the perforate core.

Apparatus for replacing the cardboard core with a perforate core is disclosed in the aforesaid patent. However, such apparatus is subject to various drawbacks. The apparatus employs a vertically movable mandrel upon which is placed a perforate core. Upon actuation, the perforate core is pushed downwardly into engagement with a cardboard core in the yarn package, whereupon the continued downward movement causes the perforate core to push the cardboard core completely out of the package. Owing to the pressure and movement of the entering perforated core, there is a tendency of the yarn package to come apart and unduly distort. The apparatus is only able to process yarn packages singly whereas multiple package processing is more desirable for economy and efficiency purposes. Further, owing to the fact that both the cardboard transfer core and perforated dye core simultaneously move through the yarn it has been found necessary to sandwich a paper or knit sleeve or sock between the yarn and the transfer core to serve as a bridge or shield during transfer. Without the sleeve it has been observed that some of the strands of yarn become trapped between the ends of the transfer core and the dye core during the operation, thereby disturbing the continuity of the yarn.

As set forth in the above-referenced application Ser. No. 105,920, it has been found that the above drawbacks and disadvantages are overcome by placing a replacement dye core within the cardboard transfer core and thereafter pulling the cardboard core out of the yarn package to permit the package to contract around the replacement core. Apparatus for performing such a process has been proposed as set forth in the co-pending application. While achieving satisfactory results, further improvements have now been provided for simultaneously processing at least two yarn packages in continuous operation. Provision is also made for effective handling and disposing of the cardboard transfer core.

SUMMARY OF THE INVENTION

It is, therefore, a primary object of the invention to provide an apparatus adapted to continuously process multiple yarn packages by replacing the impervious transfer core of each yarn package with a foraminous replacement core of a predetermined smaller diameter.

It is another object of the invention to provide an apparatus of the foregoing type for continuously processing package cores and thereafter disposing the transfer cores.

The above and other objects are satisfied by an apparatus including an endless conveyor supported by a frame and a core replacement station adjacent the conveyor. A plurality of spaced apart yarn package supports are arranged on the conveyor. Indexing means are also present for sequentially indexing each of the supports at the core replacement station. A mechanism associated with the feed station is utilized for pulling the transfer core from each of the yarn packages conveyed to and indexed at the feed station. Also present at the feed station are means adapted to cooperate with the pulling means for preventing axial movement of the package during removal of the transfer core.

BRIEF DESCRIPTION OF THE DRAWINGS

Other objects and advantages of the invention will become apparent from the following detailed description of the invention which is to be taken in conjunction with the accompanying drawings illustrating a preferred embodiment of the invention in which:

FIG. 5 is a fragmentary enlarged sectional view showing the core pulling assembly after removal of the transfer core from the yarn package.

DETAILED DESCRIPTION

Figure 1:
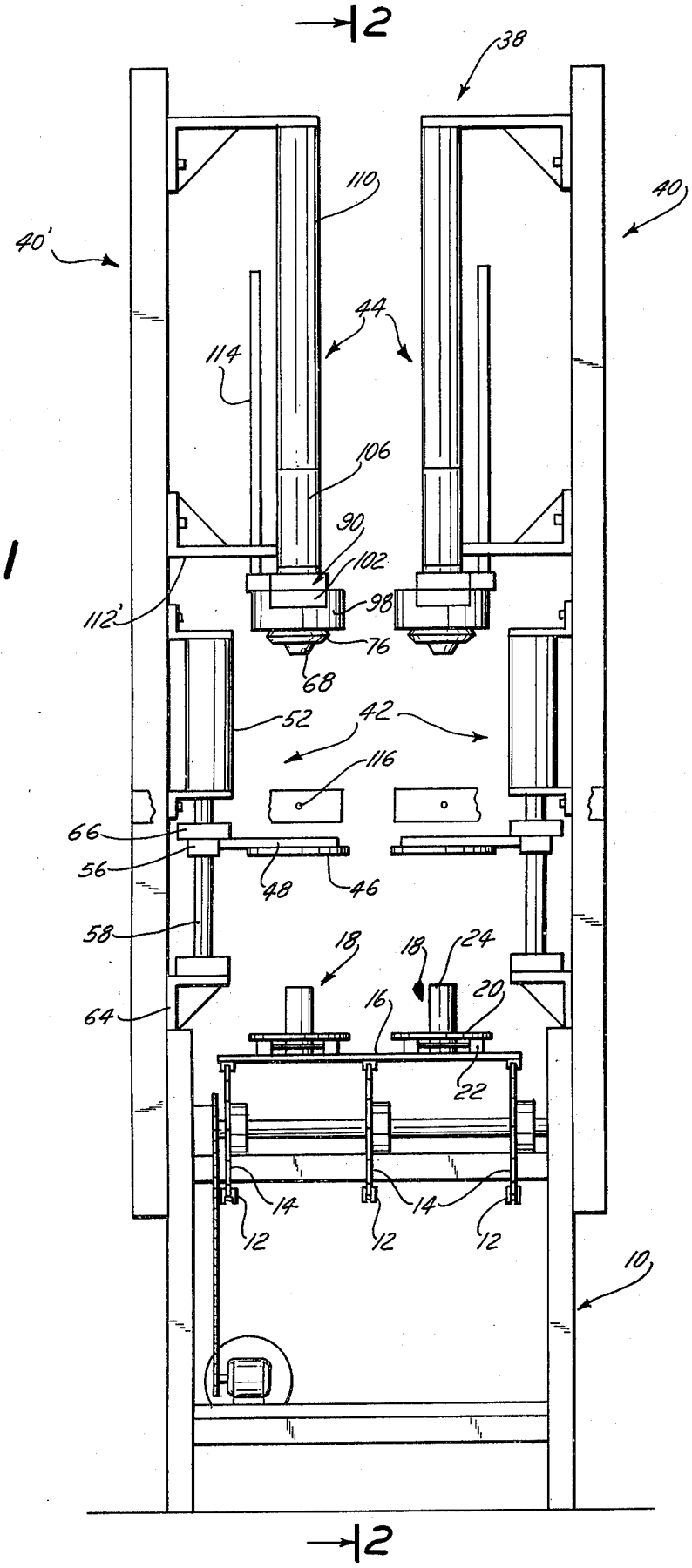
FIG. 1 is an end elevational view illustrating the core transfer apparatus of the invention.
Figure 2:
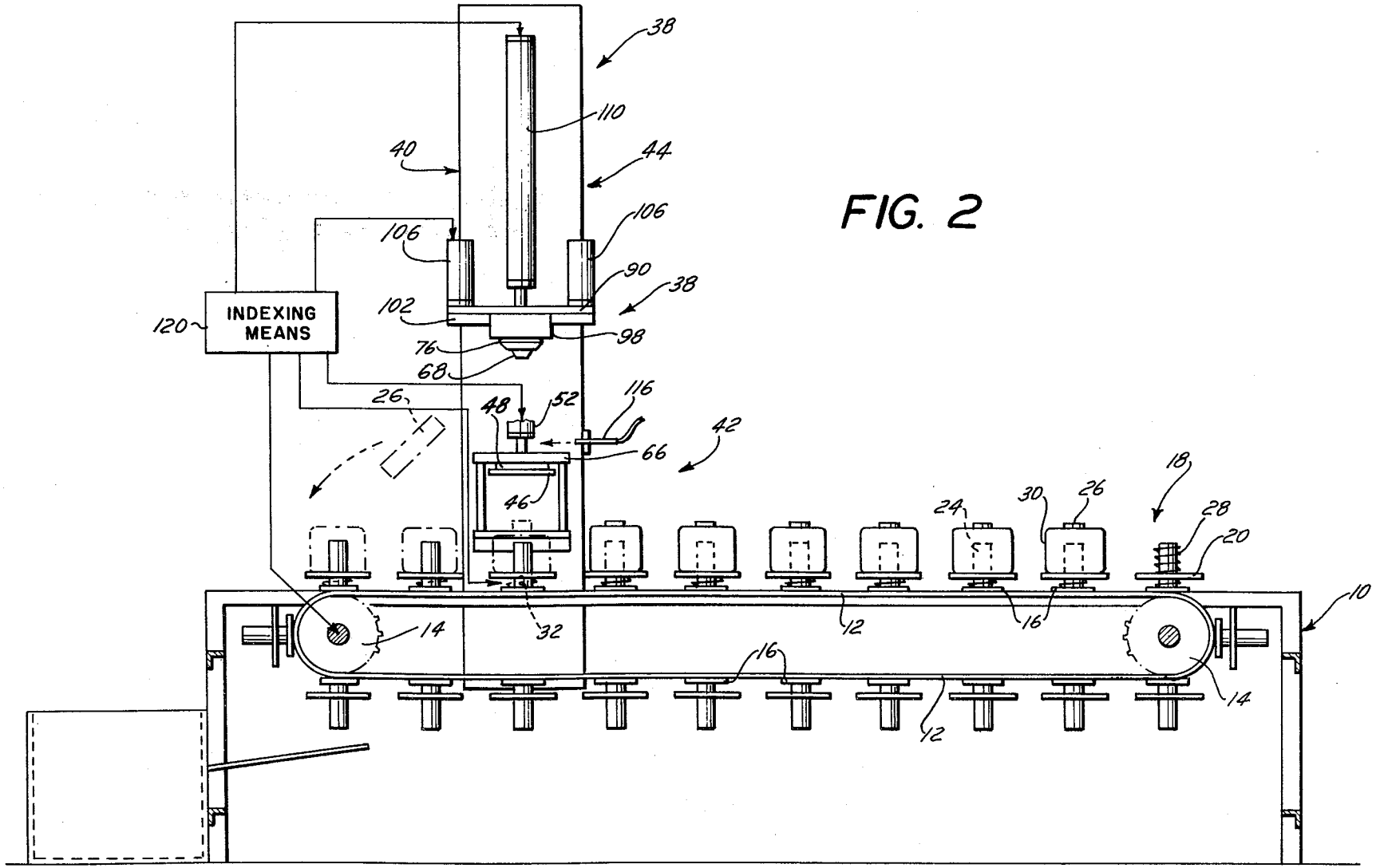
FIG. 2 is a front plan view taken along line 2—2 of FIG. 1.

As illustrated in FIGS. 1 and 2 the core transfer apparatus of the invention includes frame 10 upon which is carried three spaced driven chains 12. A conventional chain drive (not shown) drives the endless chains through sprocket wheels 14 located at opposite ends of the frame. A series of spaced apart conveyor plates 16 are carried in parallel rows by the chains 12.

Each conveyor plate 16 carries a yarn package support assembly 18. As illustrated in the drawings and particularly FIGS. 1, 3 and 4, support assembly 18 includes annular horizontal spacing plate 20 supported from conveyor plate 16 by vertical pillars 22. Protruding through a central hole in spacing plate 20 is vertical mandrel 24 which is threaded into conveyor plate 16. An intermediate plate 17 cooperates in supporting the lower end of core 26.

A foraminous replacement core such as a coil spring or a perforated plastic tube of smaller diameter than the original cardboard transfer core 26 is placed over the mandrel as shown in FIG. 2. It is also contemplated that replacement core 28 be in the form of a spring, which is designed in such a way that the lacing when empty gives an effective diameter to the spring which is larger than the inside diameter of the cardboard core 26. However, upon insertion of the spring 28 into the core, the nature of the lacing is such that the spring can be compressed within the cardboard core. It is virtually a hand operation necessitated by the fact that the diameter of the spring before insertion is larger than the inside diameter of the transfer core. The operator merely compresses the spring to permit it either to be forced into the transfer core or in the alternative for the transfer core to be forced over the spring. The reason for such a tight fit, is to permit little if any space to exist between the inside core of the yarn and the outside surface of the replacement core or spring. The replacement core 28 extends through the orifice in spacing plate 20 and rests on conveyor plate 16 (see FIG. 4). Yarn package 30 is supported by spacing plate 20. In order to further arrest the movement of the replacement core during the transfer core pulling operation, a horizontally disposed hole or channel 32 is placed in the base portion of the mandrel. Prior to the core pulling operation a reciprocable rod 34 illustrated in FIG. 3 and carried at the core pulling station is inserted through the replacement core 28 into the channel by a conventional air or hydraulic actuated cylinder 36.

Figure 3:
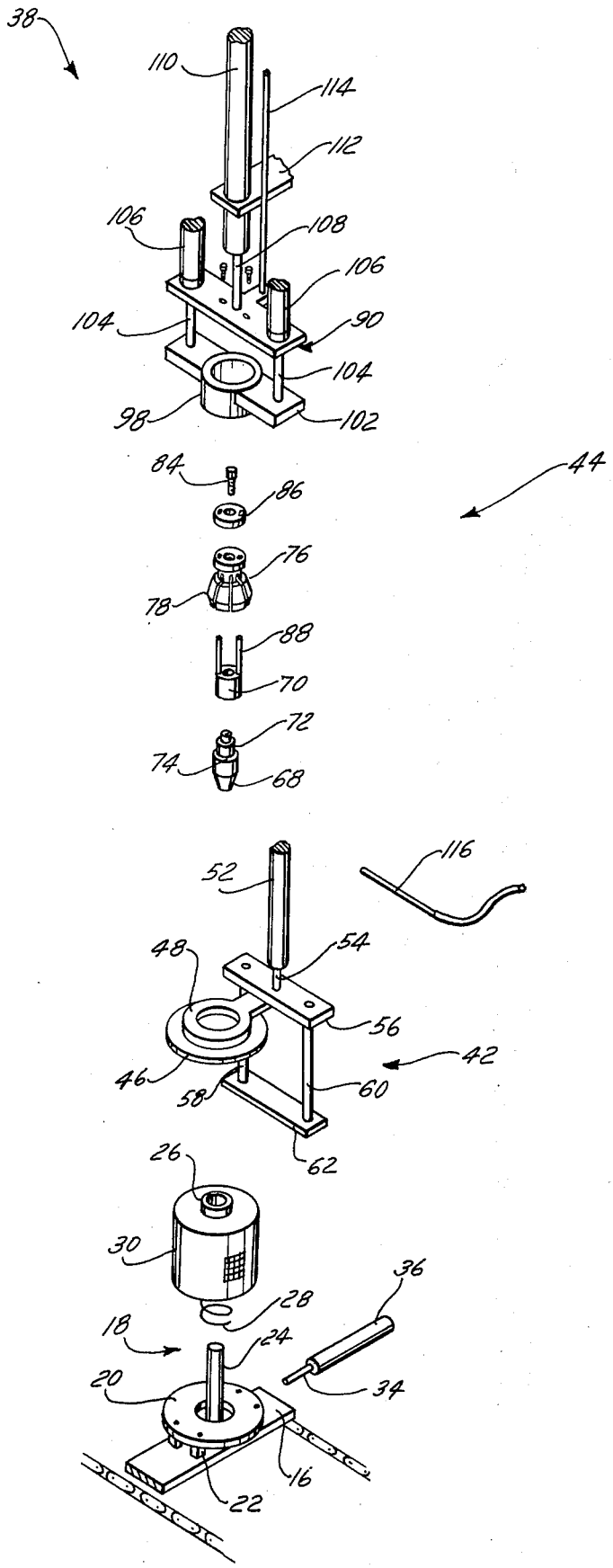
FIG. 3 is an exploded view illustrating the core pulling mechanism of the apparatus.

A core pulling station 38 is provided for cooperating in removing the transfer core 26 from the yarn packages 30. As illustrated in FIGS. 1-3, the station preferably includes first and second core pulling assemblies 40, 40'. Each pulling assembly has associated therewith a yarn package restraining sub-assembly 42 and a transfer core removing head assembly 44.

Figure 4:
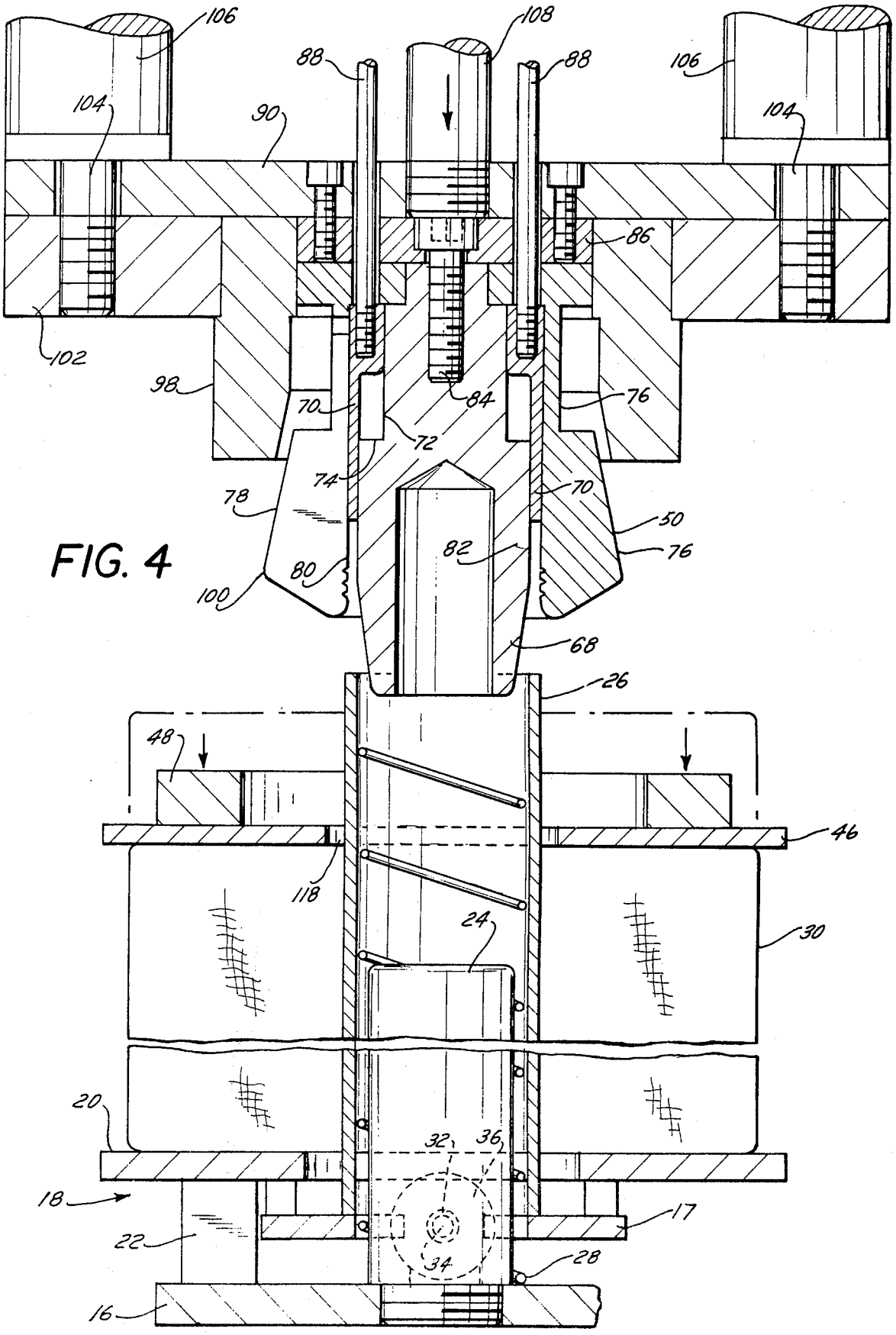
FIG. 4 is an enlarged fragmentary sectional view showing the core pulling head before grasping the transfer core with hold down plate restraining the yarn package.
Figure 4A:
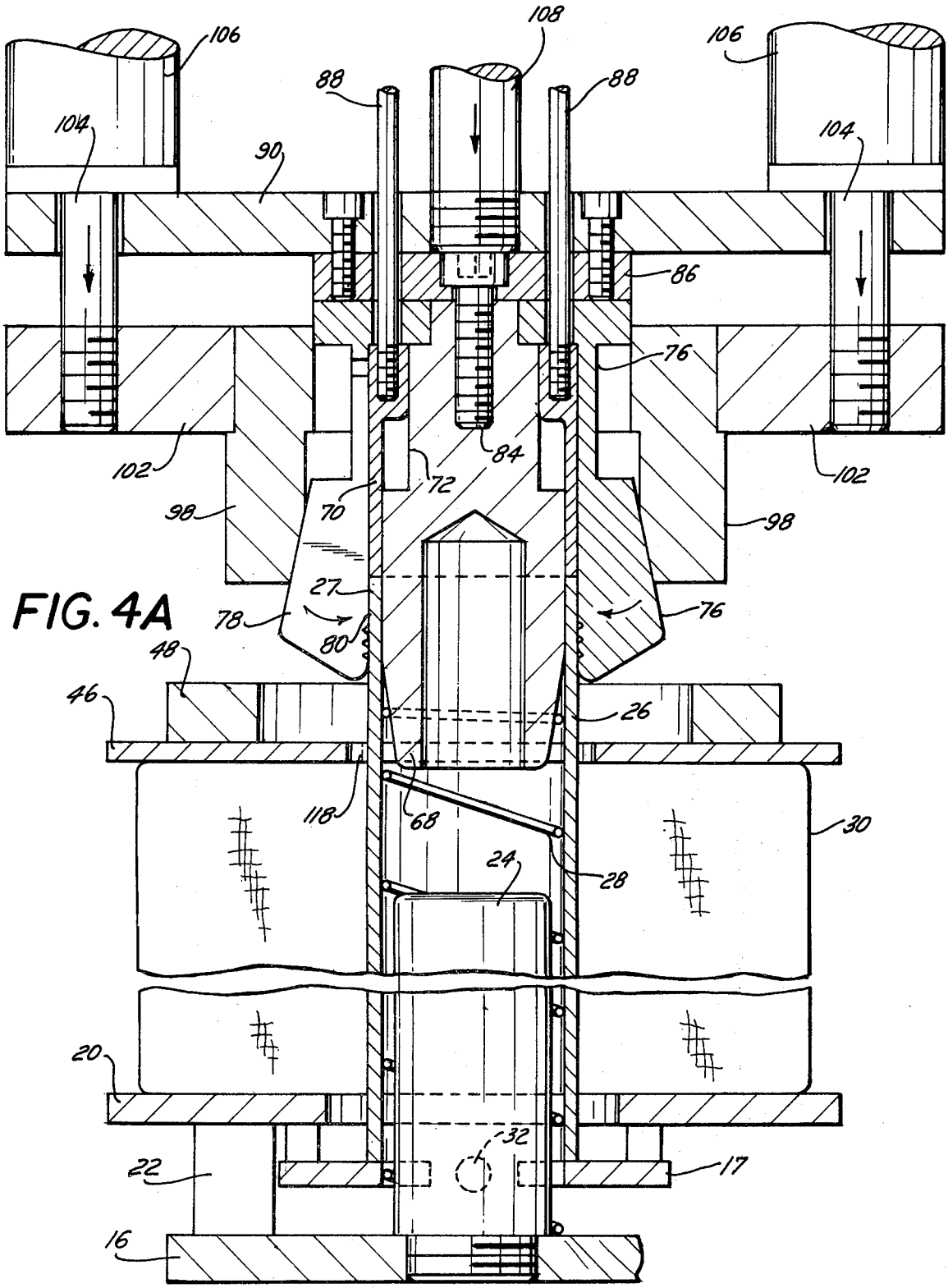
FIG. 4*a* is an enlarged fragmentary sectional view showing the core pulling head after grasping the transfer core with the hold down plate restraining the yarn package.

The yarn restraining sub-assembly 42 operates to arrest any possible movement of the yarn package 30 during transfer core removal; and it includes an annular hold down plate or pressure pad 46, which, as illustrated in FIG. 4, is adapted to abut the upper end of the yarn package during core transfer. Improper spacing of the yarn windings on core 26 are overcome by the downward movement of the plate 46, the bottom of which stroke insures that the yarn is in firm contact with the spacing plate 20. The relationship of the spacing plate to the elevation of the cores 28 is a constant which is maintained for uniform spacing of the yarns on the spring. It has been found desirable to have the plate 46 slightly compress the package (see FIG. 4), in order to loosen the grip of the yarn on the cardboard tube 26, and permit easier withdrawal. The axial compression of cross-wound packages, results in some relaxation of the yarn, and consequent easier withdrawal of the cardboard core 26. Slight compression also provides a uniform containment between the spacing and the restraining plates, the distances between the plates being somewhat less than normal distance between the ends of the yarn on an untreated package. The hold down plate has a central orifice extending therethrough to permit the transfer core to be pulled therethrough. The hold down plate 46 has a support collar 48 attached to its upper surface. The support collar has a central orifice of sufficient diameter to permit split ring or jaw clamp 76 to extend therein during engagement with the transfer core 26.

The hold down plate 46 is attached to a reciprocating mechanism which permits the hold down plate to be raised and lowered as desired during the sequential operation of the apparatus. The hold down plate actuating mechanism includes an air actuated piston disposed within cylinder 52 connected to one face of the pulling assembly. A reciprocating rod 54 is vertically disposed from the cylinder and is attached to hold down plate bushing 56. Plate bushing 56 is a generally rectangular metal plate to which is bolted or connected support collar 48. During movement of the hold down plate, bushing 56 reciprocates vertically along travel rods 58 and 60. The travel rods are supported by rectangular bottom stop plate 62 which is connected to pulling assembly 40' by means of support 64.

Movement of the hold down plate 46 is arrested at the lowermost vertical position by bottom stop plate 62 and at its uppermost position by top stop 66. A pair of holes are provided in the plate bushing 56 to permit the travel rods to extend therethrough.

Figure 5A:
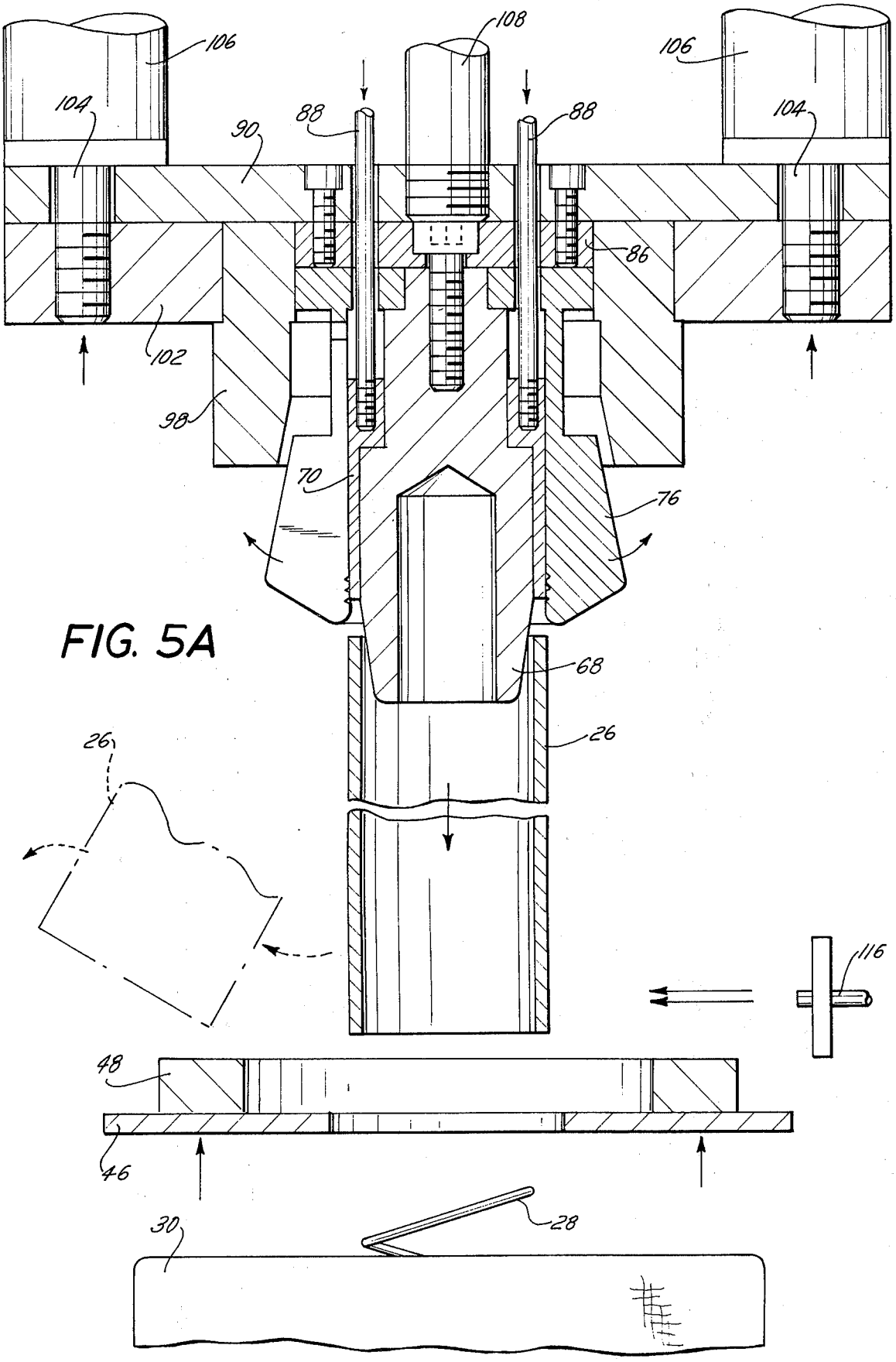
FIG. 5*a* is a fragmentary enlarged sectional view showing removal of the transfer core from the core pulling assembly.

In FIGS. 3–5, pulling head assembly 44 is illustrated. A pair of pulling head assemblies 44 are mounted at opposed sides of pulling station 38 (See FIG. 1). Each pulling assembly is in vertical axial alignment with the hold down plate 46 of the associated yarn restraining subassembly 42. Pulling head assembly 44 includes chuck 68 which is adapted to internally and frictionally engage transfer core 26. Cylindrical collet 70 has a central orifice extending therethrough and is adapted to frictionally engage the upper portion 72 of pilot pin or chuck 68 and rest on chuck shoulder 74. A collet or jaw clamp 76 is concentrically disposed about collet 70 and chuck 68. Clamp 76 has a split skirt 78 adapted to be compressed inwardly by external pressure. As illustrated in FIG. 4, a cylindrical space is provided between the inner surface 80 of split skirt 78 and the bottom surface 82 of chuck 68. The spacing is sufficient to permit the transfer core to be disposed therein during engagement thereof. The gripping assembly formed from clamp 76, collet 70 and chuck 68 is secured together by means of bolt 84 and spacer 86. A pair of stabilizing rods 88 extend from the upper face of collet 70 and extend through travel plate 90.

An annular locking collar or constriction ring 98 is adapted to frictionally engage split skirt 78 and compress the skirt inwardly toward chuck 68 to frictionally engage transfer core 26 as illustrated in FIG. 5. For this purpose, the constriction ring should be of somewhat larger diameter than the widest portion 100 of the split skirt 78. A pair of integral wings 102 extend outwardly in opposite directions from the uppermost portion of the constriction ring. In order to permit reciprocation of the constriction ring between a lowermost position as illustrated in FIG. 5 adjacent the bottom of split skirt 78 to an uppermost position as illustrated in FIG. 4 in engagement with travel plate 90, travel rods 104 are provided. Rods 104 are threaded into wings 102 at their lowermost portions and are connected at their uppermost portions through travel plate 90 to air cylinders 106. Air cylinders 106 are adapted to reciprocate travel rods 104 to a lowermost and uppermost position in a preselected sequential manner.

Gripping head assembly 44 is connected by means of bolts (not shown) to travel plate 90 and thusly, moves therewith. Air cylinders 106 are also connected to travel plate 90 for movement therewith. Further, constriction ring 98 is connected to air cylinders 106 through travel rods 104 and is also adapted to move with travel plate 90. However, constriction ring 98 is adapted to independently move in reciprocal fashion with respect to travel plate 90 by means of the air cylinders. In order to permit the gripping head assembly 44 and constriction ring 98 to move from a first position as illustrated in FIG. 2 above the yarn package to a second position wherein the chuck 68 and clamp 76 are in frictional engagement with the upper edge of the transfer core 26, travel plate 90 is connected to piston rod 108. Piston rod 108 is the reciprocating rod for air cylinder 110 which is in vertical alignment with the central axis of locking collar 98 and the vertical axis extending through the gripping head assembly 44. As illustrated in FIG. 1 air cylinder 110 is connected to the pulling assembly support 40' by means of horizontal supports 112, 112'.

An aligning shaft 114 provides additional alignment support for the gripping head assembly 44 when it is in the lowermost position adjacent the transfer core 26. Aligning shaft 114 is connected at its lowermost portion to travel plate 90 and is adapted to move therewith. Aligning shaft 114 also extends through support 112' which serves to prevent lateral movement of this shaft when in its lowermost position.

An air jet 116 is provided fpr blowing the transfer cores 26 into a collecting bin (not shown). The air jet is on the pulling assembly 40 such that when the gripping head assembly 44 is in its withdrawn uppermost position and the transfer core 26 is released, it can blow this core into the collecting bin.

In operation, as illustrated in FIG. 2, a spring or perforated replacement core 28 is placed over mandrel 24 by the machine operator. Next, the yarn package containing the transfer core 26 is placed over the mandrel 24 until it rests on spacing plate 20. Another core and yarn package is placed on the aligned companion mandrel on the chain conveyor. Next the conveyor chain is energized. The mandrel loading procedure is repeated for the remaining mandrels as they turn to their upright position. Timing cams (not shown) may be employed actuating conventional four-way solenoid valves which, in turn, energize the air cylinders. Thus, the timing cam for each core pulling assembly 40 or 40' is adapted to actuate its associated four-way solenoid valve in response to movement of the conveyor chain in order to actuate sequentially air cylinder 52, air cylinder 110, air cylinder 106 and air cylinder 36, as will be discussed in further detail hereinafter. This controlling means or indexing means 120 is shown schematically in FIG. 2 and is of the general type which is well-known to those skilled in the conveyor art. As a pair of mandrel supported yarn packages approach the core pulling station 38, they are indexed and placed in vertical alignment with the gripping head assembly 44 and hold down plate assembly 46. At this point, both the hold down plate assembly and gripping head assembly are in their raised position. Next, the holddown plate air cylinder 52 is actuated to permit the holddown plate to descend into frictional engagement with the top surface 118 of yarn package 30. Simultaneously therewith or shortly thereafter, pulling head air cylinder 110 is actuated thereby driving travel plate 90 downwardly to permit the gripping head assembly 44 to descend about the top end of transfer core 26. After the chuck 68 has descended into the transfer core and the clamp 76 has been concentrically disposed about the core 26, the air cylinders 106 driving the constriction ring 98 are activated to lower the rings into compressing engagement with the widest portion 100 of clamp split skirt 78. This movement drives the split skirt toward the chuck thereby causing gripping of the upper end of the transfer core 26. Prior to this time or before the transfer core is pulled from the yarn package reciprocal rod 34 will have been directed in the channel 32 of the mandrel by air cylinder 36 to prevent the replacement core 28 from moving with respect to the yarn package during the core pulling operation.

Next, air cylinder 110 is actuated to raise the gripping head assembly 44 to pull the transfer core 26 out of the yarn package. The holddown plate air cylinder 52 is then actuated to release the yarn package. Simultaneously therewith or sometime shortly thereafter, air cylinders 106 are actuated to raise travel rods 104 to lift the associated constriction ring 98 to the position as illustrated in FIG. 4 at which the transfer core 26 is released from the clamp 76. At this time, air cylinder 110 is actuated again to raise the assembly 44 about 2 inches to permit the core 26 to fall freely. Simultaneously therewith, the air jet is actuated to blow the released core 26 into the collection bin (not shown).

Thereafter, the entire operation is repeated with the next pair of yarn packages being indexed at the pulling station.

It will be obvious to those skilled in the art that various modifications may be made to the apparatus hereinbefore described. Such embodiments are considered to be within the scope of the invention. The above invention is not be limited except as set forth in the following claims:

I claim:

1. A method for transferring a package of yarn supported by a rigid imperforate transfer core to a foraminous, resilient dye core of predetermined diameter comprising, in sequence, the steps of:

a. compressing the resilient core to reduce its size;
b. inserting the resilient core into the transfer core;
c. anchoring the resilient core against axial displacement; and
d. axially removing the transfer core relative to both the package of yarn and the resilient core.

2. The invention in accordance with claim 1 wherein the compression of the resilient core is released to facilitate its interengagement with the package of yarn following removal of the transfer core.

3. The invention in accordance with claim 2 wherein the transfer core is gripped and thereafter pulled axially in removing it from between the yarn package and the resilient core.

4. The invention in accordance with claim 3 wherein the package of yarn is held stationary during the withdrawal of the transfer core.

5. A method for transferring a package of yarn supported by a transfer core to a replacement core comprising, in sequence, the steps of:

a. inserting the replacement core into the transfer core;

b. anchoring the replacement core against axial displacement;

c. compressing the package of yarn;

d. gripping and thereafter pulling the transfer core axially in removing it from between the yarn package and the replacement core; and e. holding the package of yarn stationary during the withdrawal of the transfer core.

6. The invention is accordance with claim 5 wherein the transfer core is ejected and removed to another location after removal from the yarn package.

7. A method for transferring a package of yarn supported by a transfer core to a replacement core comprising, in sequence, the steps of:

a. inserting the replacement core into the transfer core;

b. gripping and thereafter pulling the transfer core axially in removing it from between the yarn package and replacement core;

c. holding the package of yarn stationary during the withdrawal of the transfer core; and d. permitting the yarn and the replacement core to interengage in completing the transfer of the yarn onto the replacement core.

8. The invention in accordance with claim 7 wherein the replacement core is anchored against axial displacement during the removal of the transfer core.

9. The invention in accordance with claim 7 wherein the replacement core is a foraminous dye penetrating core.

10. The invention in accordance with claim 9 wherein the foraminous dye penetrating core is a perforated plastic tube.

* * * * *